US008870611B2

(12) United States Patent
Sato et al.

(10) Patent No.: US 8,870,611 B2
(45) Date of Patent: Oct. 28, 2014

(54) CRIMPING TERMINAL AND CONNECTION STRUCTURE OF CRIMPING TERMINAL TO ELECTRIC WIRE

(75) Inventors: Kei Sato, Makinohara (JP); Shinji Kodama, Makinohara (JP)

(73) Assignee: Yazaki Corporation, Tokyo (JP)

( * ) Notice: Subject to any disclaimer, the term of this patent is extended or adjusted under 35 U.S.C. 154(b) by 24 days.

(21) Appl. No.: 13/636,719

(22) PCT Filed: Mar. 28, 2011

(86) PCT No.: PCT/JP2011/057709

§ 371 (c)(1),
(2), (4) Date: Sep. 24, 2012

(87) PCT Pub. No.: WO2011/125626

PCT Pub. Date: Oct. 13, 2011

(65) Prior Publication Data

US 2013/0012077 A1 Jan. 10, 2013

(30) Foreign Application Priority Data

Mar. 31, 2010 (JP) ..... 2010-081810

(51) Int. Cl.
*H01R 4/10* (2006.01)
*H01R 4/18* (2006.01)

(52) U.S. Cl.
CPC ..... *H01R 4/188* (2013.01); *H01R 4/185* (2013.01)
USPC ..... 439/877; 439/442

(58) Field of Classification Search
USPC ..... 439/421, 423, 442, 884, 877–882
See application file for complete search history.

(56) References Cited

U.S. PATENT DOCUMENTS 4,992,064 A * 2/1991 Steinhardt et al. ..... 439/845
5,025,554 A * 6/1991 Dohi ..... 29/860
5,733,154 A * 3/1998 Libregts ..... 439/850

(Continued)

FOREIGN PATENT DOCUMENTS

JP 41-17260 B1 9/1966
JP 43-26203 Y1 11/1968

(Continued)

OTHER PUBLICATIONS

International Search Report (PCT/ISA/210) dated Jun. 7, 2011 issued in corresponding International Application No. PCT/JP2011/057709.

(Continued)

*Primary Examiner* — Thanh Tam Le
(74) *Attorney, Agent, or Firm* — Sughrue Mion, PLLC

(57) ABSTRACT

Provided is a crimping terminal, having a conductor crimping portion of a wire connection portion formed so as to have a substantially U-shaped cross-section with a bottom plate and a pair of conductor caulking pieces, and a sheath caulking portion formed so as to have a substantially U shaped cross-section with a bottom plate and a pair of sheath caulking pieces. The bottom plate of the conductor crimping portion and the bottom plate of the sheath caulking portion are continuously formed as a common bottom plate, and the wire connection portion, which is provided therein with a pair of covering walls formed continuously between the conductor caulking piece and the sheath caulking piece, is formed on an entire inner surface thereof with serrations, in the direction of intersecting with a longitudinal direction of electric wire.

6 Claims, 17 Drawing Sheets

(56) References Cited

U.S. PATENT DOCUMENTS

| | | | | |
|---|---|---|---|---|
| 6,139,376 | A * | 10/2000 | Ooya et al. | 439/843 |
| 6,290,556 | B1 * | 9/2001 | Howland et al. | 439/879 |
| 6,626,711 | B2 * | 9/2003 | Kitagawa et al. | 439/877 |
| 7,121,903 | B2 * | 10/2006 | Sakaguchi et al. | 439/877 |
| 7,174,633 | B2 * | 2/2007 | Onuma | 29/854 |
| 7,775,842 | B2 * | 8/2010 | Yamagami | 439/877 |
| 7,828,612 | B2 * | 11/2010 | Kumakura | 439/877 |
| 7,905,755 | B1 * | 3/2011 | Martauz | 439/877 |
| 8,210,884 | B2 * | 7/2012 | Corman et al. | 439/877 |
| 8,251,759 | B2 * | 8/2012 | Matsunaga | 439/885 |

FOREIGN PATENT DOCUMENTS

| | | | |
|---|---|---|---|
| JP | 3-106667 | U | 11/1991 |
| JP | 10-312844 | A | 11/1998 |
| JP | 2009-135105 | A | 6/2009 |
| JP | 2010-15915 | A | 1/2010 |
| JP | 2010-56022 | A | 3/2010 |

OTHER PUBLICATIONS

Written Opinion (PCT/ISA/237) dated Jun. 7, 2011, issued in corresponding International Application No. PCT/JP2011/057709.

Office Action dated Feb. 4, 2014, issued by the Japanese Patent Office in counterpart Japanese Application No. 2010-081810.

Office Action dated May 7, 2014 issued by the Japanese Patent Office in counterpart Japanese Patent Application No. 2010-081810.

Machine Translation of Japanese Publication No. 2010-015915 dated Jan. 21, 2010.

Office Action dated Aug. 4, 2014 in Chinese Patent Application No. 201180017446.X.

* cited by examiner

CRIMPING TERMINAL AND CONNECTION STRUCTURE OF CRIMPING TERMINAL TO ELECTRIC WIRE

CROSS REFERENCE TO RELATED APPLICATION

This is a national stage entry of International Application No. PCT/JP2011/057709 filed Mar. 28, 2011, which claims the benefit of Application No. JP 2010-081810 filed Mar. 31, 2010, in the Japan Patent Office (JPO), the disclosure of which are incorporated herein in its entirety by reference.

TECHNICAL FIELD

The present invention relates to a crimping terminal and a connection structure of the crimping terminal to electric wires.

BACKGROUND ART

A common crimping terminal is provided at the front portion thereof with an electric connection portion for connecting to a mating terminal and the like, and at the rear portion thereof with a wire connection portion that is caulked and connected to a terminal portion of an electric wire. The wire connection portion usually has a structure in which a conductor crimping portion is arranged on the front side thereof and a sheath caulking portion is arranged at intervals in the rear side thereof. The conductor crimping portion and the sheath caulking portion each are provided with a bottom plate and a pair of caulking pieces extended upwardly from both side edges of the bottom plate so as to have a substantially U-shaped cross section. The caulking piece of the conductor crimping portion and the caulking piece of the sheath caulking portion are spaced apart independently of each other.

However, in such a crimping terminal, since the caulking piece of the conductor crimping portion and the caulking piece of the sheath caulking portion are spaced apart from each other, there has been a possibility that the wire conductor is exposed between the conductor crimping portion and the sheath caulking portion when the caulking piece of the conductor crimping portion is bent inwardly to crimp the conductor having been exposed by removing an insulation sheath of the terminal portion of the electric wire, and at the same time, when the caulking portion of the sheath caulking portion is bent inwardly to caulk an insulation-sheath portion, there is a possibility that moisture is adhered to the exposed conductor portion thereby leading to corrosion thereof.

A crimping terminal for solving the problems has been proposed in Patent Document 1 as described therein. FIGS. 23A and 23B show the configuration of the crimping terminal described in Patent Document 1, FIG. 24 shows the state where the crimping terminal is connected to the terminal portion of electric wire, and FIG. 25 shows the problem of the crimp terminal having been described in Patent Document 1.

As shown in FIGS. 23A and 23B, and FIG. 24, the crimping terminal 110 is provided in the front portion thereof with an electric connection portion 111 for connecting to a mating terminal (not shown) and the like, and in the rear portion thereof with a wire connection portion 112 that is caulked and connected to the terminal portion of the electric wire W, and the wire connection portion 112 and the electric connection portion 111 are integrally connected therebetween to a connection portion 113.

The wire connection portion 112 is provided with a conductor crimping portion 114 that is located in the front side thereof and a sheath caulking portion 115 that is located in the rear side thereof. The conductor crimping portion 114 is formed so as to have a U-shaped cross section with a bottom plate 121 and a pair of conductor caulking pieces 122 which are extended upwardly from both side edges of the bottom plate 121 and bent inwardly to enclose a conductor Wa having been exposed by removing the insulation sheath Wb of the terminal portion of electric wire W to be connected thereto thereby caulking the conductor Wa so as to be in close contact with the upper surface of the bottom plate 121. Similarly, the sheath caulking portion 115 is formed so as to have a U-shaped cross section with a bottom plate 123 and a pair of sheath caulking pieces 124 which are extended upwardly from the both side edges of the bottom plate 123 and bent inwardly to embrace a portion covered by the insulation sheath Wb of the terminal portion of the electric wire W to be connected thereto thereby caulking the insulation sheath Wb portion of the terminal portion of the electric wire W so as to be in close contact with the upper surface of the bottom plate 123. The bottom plate 121 of the conductor crimping portion 114 and the bottom plate 123 of the sheath caulking portion 115 are formed with a common continuous bottom plate via an electric connection portion 113 from the electric connection portion 111. In addition, the conductor crimping portion 114 is provided on the inner circumferential surface thereof with a serration 131 to increase the continuity of contact with the conductor Wa of wire W.

And, as a characteristic point of the crimping terminal 110, the conductor caulking piece 122 of the conductor crimping portion 114 and the sheath caulking piece 124 of the sheath caulking portion 115 are provided therebetween with a covering wall 117 that is plastically deformed so as to cover the portion between the conductor press-camping portion 114 and the sheath caulking portion 115 according to the caulking process of the conductor caulking pieces 122 and the sheath caulking pieces 124. In other words, the covering wall 117 is formed with a continuous wall that is integrally formed continuously from the conductor caulking pieces 122 of the conductor crimping portion 114 to the sheath caulking portion 124 of the sheath caulking portion 115.

Here, the upper end edge of the covering wall, which is continuously formed from the conductor crimping portion 114 to the sheath caulking portion 115, is formed in a straight line shape extended obliquely relative to the longitudinal direction of the bottom plate portions 121, 123 because the upper end edge of the conductor caulking piece 122 of the conductor crimping portion 114 is positioned lower in its height than the upper end edge of the sheath caulking piece 124 of the sheath caulking portion 115.

According to the crimping terminal 110, as shown in FIG. 24, the covering wall 117, which is provided between the conductor crimping portion 114 and the sheath caulking portion 115, serves to cover the conductor Wa of the electric wire W having been exposed between the conductor crimping portion 114 and the sheath caulking portion 115 in a state where the crimping terminal 110 is crimped to the terminal portion of the wire W, thereby preventing moisture or dust from being adhered thereto, as a result, the problem of corrosion of the conductor Wa can be suppressed.

PRIOR ART DOCUMENT

Patent Documents

Patent Document 1: Japanese Patent Application Publication No. 2010-15915A

SUMMARY OF INVENTION

Problems to Be Solved by Invention

However, in the above-described conventional crimping terminal 110, when the pair of sheath caulking pieces 124 of the sheath caulking portion 115 is bent inwardly to caulk the insulation sheath Wb of the electric wire W, the adhesion of the insulation sheath Wb to the inner surface of the sheath caulking portion 115 tends to be weak because the adhesion is made by the contact between the simple surfaces thereof only. Accordingly, as shown in FIG. 25, if moisture S has penetrated from the rear end 115*e* of the sheath caulking portion 115, there is a possibility that the moisture S is transmitted through the gap between the insulation sheath Wb and the inner surface of the sheath caulking portion 115 to reach the conductor Wa positioned deep inside the crimping terminal.

The present invention has been made in view of the above-mentioned circumstances, and an object of the present invention is to provide a crimping terminal and a connection structure of the crimping terminal to an electric wire, which are able to prevent moisture from being infiltrated toward a conductor of wire from a rear end of a sheath caulking portion, thereby aiming at suppressing corrosion of the conductor.

Means for Solving Problems

In order to achieve the object described above, a crimping terminal according to the present invention is characterized by (1) to (4) below.

(1) A crimping terminal having an electric connection portion for connecting to a mating terminal in a front portion thereof and a wire connection portion that is caulked and connected to a terminal portion of electric wire in a rear portion thereof, wherein the wire connection portion is provided with a conductor crimping portion positioned in a front side thereof and a sheath caulking portion positioned in a rear side thereof, wherein the conductor crimping portion is formed so as to have a substantially U-shaped cross section with a bottom plate and a pair of conductor caulking pieces which are extended upwardly from both side edges of the bottom plate and bent inwardly to enclose a conductor having been exposed by removing an insulation sheath of a terminal of an electric wire to be connected thereto thereby caulking the conductor so that the conductor is in close contact with an upper surface of the bottom plate, wherein the sheath caulking portion is formed so as to have a substantially U-shaped cross section with a bottom plate and a pair of sheath caulking pieces which are extended upwardly from both side edges of the bottom plate and bent inwardly to enclose an insulation sheath portion of a terminal of an electric wire to be connected thereto thereby caulking the insulation sheath portion so that the insulation sheath portion is in close contact with an upper surface of the bottom plate, wherein the bottom plate of the conductor crimping portion and the bottom plate of the sheath caulking portion are formed as a common bottom plate, and the conductor caulking pieces and the sheath caulking pieces are formed therebetween with a pair of continuous covering walls, and wherein the wire connection portion is provided on an entire inner surface thereof with concave portions or convex portions in a direction of intersecting with a longitudinal direction of the electric wire.

(2) The crimping terminal according to the configuration of the above (1), wherein a chamfered portion is provided in a corner portion where an upper edge and a rear edge of the pair of sheath caulking pieces are intersected with each other.

(3) The crimping terminal according to the configuration of the above (1) or (2), wherein the conductor crimping portion or a front side of the conductor crimping portion is provided with a positioning portion to regulate the position of the tip of the conductor of the electric wire inserted into the conductor crimping portion.

(4) The crimping terminal according to the configuration of anyone of the above (1) to (3), wherein upper edges of the pair of covering walls are formed in a straight line parallel to the bottom plate, and a distance from the upper edge of one of the covering walls to the upper edge of the other of the covering walls is set to be substantially equal to a diameter of the conductor of the electric wire.

According to the crimping terminal of the configuration of the above (1), since the covering wall is provided between the conductor caulking piece of the conductor crimping portion and the sheath caulking piece of the sheath caulking portion, it is possible to reduce the exposure of the conductor of the electric wire in a caulked state. Also, when the conductor caulking piece and sheath caulking piece are caulked to the terminal portion of the electric wire, the concave portions or the convex portions provided on the entire inner surface of the wire connection portion are penetrated into the insulation sheath as well as the conductor of the electric wire, thereby enhancing the adhesion between the inner surface of the sheath caulking portion and the insulation sheath of the electric wire. Moreover, since the concave portions or the convex portions are extended in a direction of intersecting with the longitudinal direction of the electric wire, the penetration route of moisture may be blocked and the infiltration of moisture may be suppressed by the complex contact configuration in which the concave portions or the convex portions are infiltrated into the sheath even though moisture tries to penetrate toward the conductor positioned deep inside from the rear end of the sheath caulking portion, thereby enabling to aim at suppressing corrosion of the conductor.

According to the crimping terminal having the configuration of the above (2), since a chamfered portion is provided in a corner portion where an upper edge and a rear edge of the pair of sheath caulking pieces are intersected with each other, the corner portion of the sheath caulking piece may be prevented from penetrating the electric wire thereby suppressing a scratch on the sheath of the electric wire According to the crimping terminal of the configuration of the above (3), since the conductor crimping portion or the front portion of the conductor crimping portion is provided with a positioning portion to regulate the position of the tip of the conductor of the electric wire inserted into the conductor crimping portion, it is possible to position easily and reliably the conductor by striking the tip of the conductor to the positioning portion. Accordingly, it becomes easier to manage certainly the position of the electric wire thereby aiming at an improvement in the quality of crimping products.

According to the crimping terminal of the configuration of the above (4), since the upper edges of the pair of covering walls are formed in a straight line parallel to the bottom plate, and the distance from the upper edge of the covering wall of one side to the upper edge of the covering wall of the other side is set to meet the diameter of the conductor of the electric wire, it is possible to avoid any useless space between the electric wire and the terminal, and enhance the effect of inhibiting the ingress of moisture.

In order to achieve the object described above, a connection structure of a crimping terminal to an electric wire according to the present invention is characterized by the followings (5) and (6).

(5) A connection structure of a crimping terminal to an electric wire, wherein: the wire connection portion of the crimping terminal according to any one of the above (1) to (4) is inserted with the terminal portion of the electric wire so that the conductor of the electric wire is mounted on the upper surface of the bottom plate of the conductor crimping portion and the insulation sheath portion of the electric wire is mounted on the upper surface of the bottom plate of the sheath caulking portion; and in that state, the pair of conductor caulking pieces of the conductor crimping portion is bent inward to embrace the conductor thereby caulking the conductor so that the conductor may be in close contact with the upper surface of the bottom plate, and the pair of sheath caulking pieces of the sheath caulking portion is bent inward to embrace the insulation sheath portion thereby caulking the insulation sheath portion so that the insulation sheath portion may be in close contact with the upper surface of the bottom plate; and whereby the concave portions or the convex portions formed on the entire inner surface of the wire connection portion penetrate the conductor of electric wire and the insulation sheath.

(6) The connection structure of the crimping terminal to the electric wire, according to the configuration of the above (5), wherein a portion which ranges from the conductor exposed in the inside or the front side of the conductor crimping portion to an overlapped portion of the pair of the sheath caulking pieces through an overlapped portion of the pair of the conductor caulking pieces is coated with an anticorrosive, in a state where the conductor caulking pieces of the conductor crimping portion and the sheath caulking pieces of the sheath caulking portion are caulked with respect to the terminal portion of electric wire.

According to the connection structure of the crimping terminal to an electric wire according to the configuration of the above (5), since the opened portion between the conductor crimping portion and the sheath caulking portion is covered and shielded by the covering wall that is mounted between from the conductor caulking piece of the conductor press-crimping portion to the sheath caulking piece of the sheath caulking portion, the exposure of the conductor of electric wire may be reduced. In addition, since the concave portions or the convex portions on the inner surface of the wire connection portion infiltrates into the conductor of electric wire and the insulation sheath, it is possible to enhance the adhesion between the insulation sheath and the inner surface of the sheath caulking portion. Moreover, since the concave portions or the convex portions are extended in the direction of intersecting with the longitudinal direction of the electric wire, even though moisture tries to penetrate toward the conductor positioned at the deep inside of the sheath caulking portion from the rear end of the sheath caulking portion, the penetration route of moisture may be blocked by the complex contact structure in which the concave portions and the convex portions infiltrate into the sheath and the penetration of moisture may be prevented accordingly, thereby aiming at suppressing corrosion of the conductor.

According to the connection structure of the crimping terminal to an electric wire according to the configuration of the above (6), since a portion which is in the range from the conductor exposed in the inside or the front side of the conductor crimping portion to an overlapped portion of the pair of the sheath caulking pieces through an overlapped portion of the pair of the conductor caulking pieces is covered with an anticorrosive, the ingression of moisture toward the conductor or the adhesion of moisture to the conductor may be prevented, and a higher corrosion-inhibition effect may be obtained, thereby aiming at a greater improvement in the reliability thereof.

Advantageous Effects of Invention

Since the concave portions and convex portions that penetrate the insulation sheath by means of the caulking process of the sheath caulking piece are formed in a direction intersecting with the longitudinal direction of the electric wire so as to be extended to the inner surface of the sheath caulking portion which is in contact with the insulation sheath of electric wire, moisture can be prevented from infiltrating toward the conductor of electric wire from the rear end of the sheath caulking portion, thereby enabling to aim at suppressing a corrosion of the conductor.

In the foregoing, a brief description of the present invention has been made. In addition, by reading through the illustrative embodiments described below with reference to the accompanying drawings to carry out the invention, details of the invention will be further clarified.

BRIEF DESCRIPTION OF DRAWINGS

FIG. 1A is a perspective view, and FIG. 1B is a planar view of an essential part of a part A of FIG. 1A.

FIG. 4A is a perspective view, and FIG. 4B is a planar view.

FIG. 7A is a perspective view, and FIG. 7B is a planar view of a main part.

FIG. 15A is a planar view of a main part of the crimping terminal before the improvement, FIG. 15B is a side view showing the caulked state of the crimping terminal, and FIG. 15C is a cross-sectional view taken along XVc-XVc show in FIG. 15B.

FIG. 17A is a view showing an example in which the upper edges of the covering wall are combined with each other, and FIG. 17B is a diagram showing an example in which one of the upper edges of the covering wall slightly overhangs the other thereof.

FIG. 18A is a view showing an example in which upper edges of the sheath caulking pieces are combined with each other, and FIG. 18B is a diagram showing an example in which one of the upper edges of the sheath caulking pieces slightly overhangs the other thereof.

FIG. 23A is a perspective view, and FIG. 23B is a planar view of a main part thereof.

MODE TO CARRY OUT INVENTION

Hereinafter, the illustrative embodiments of the present invention will be described with reference to the accompanying drawings. Incidentally, in the present invention, a portion of the crimping terminal to which a mating terminal is connected is set forth as a front portion, and a portion of the crimping terminal to which an electric wire is connected is set forth as a rear portion.

First Illustrative Embodiment

Figure 1A:
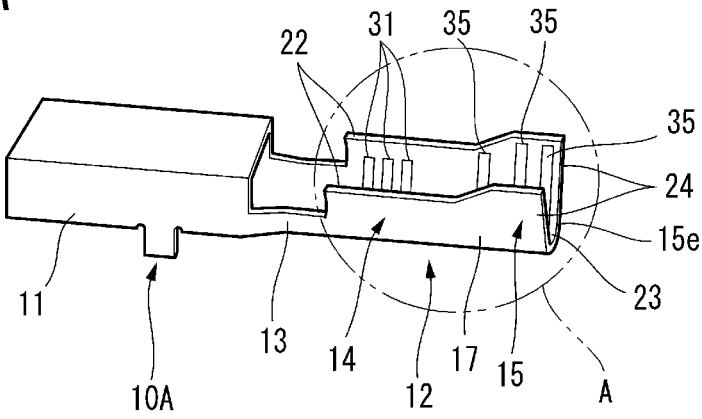
FIGS. 1A and 1B are configuration diagrams of a crimping terminal according to a first illustrative embodiment of the present invention.
Figure 1B:
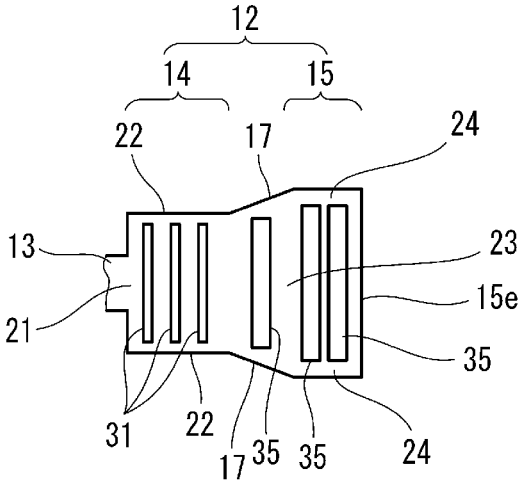
Figure 2:
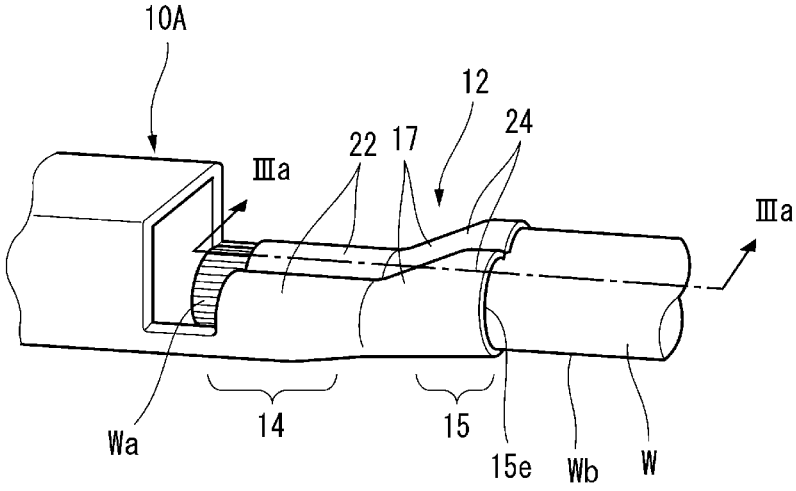
FIG. 2 is a perspective view showing a state in which the crimping terminal is caulked and connected to a terminal portion of electric wire.
Figure 3A:
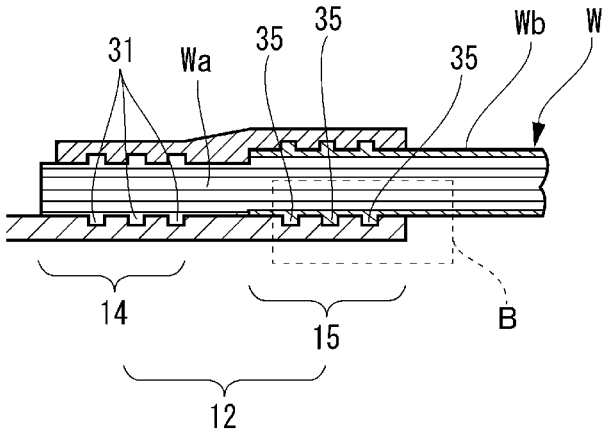
FIG. 3A is a sectional view taken along IIIa-IIIa of FIG. 2.
Figure 3B:
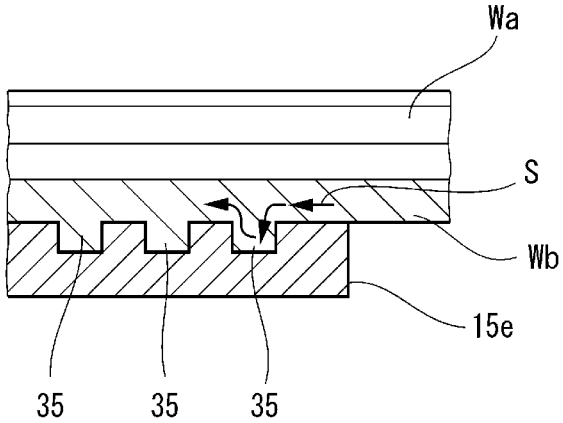
FIG. 3B is an enlarged view of a part B of FIG. 3A.

FIGS. 1A and 1B are configuration diagrams of a crimping terminal according to a first illustrative embodiment of the present invention, FIG. 1A is a perspective view, and FIG. 1B is a planar view of an essential part of the part A of FIG. 1A. FIG. 2 is a perspective view showing a state in which the crimping terminal is caulked and connected to a terminal portion of electric wire. FIG. 3A is a sectional view taken along IIIa-IIIa of FIG. 2, and FIG. 3B is an enlarged view of a part B of FIG. 3A.

As shown in FIGS. 1A, 1B and 2, the crimping terminal 10A, which is a female type, is provided in the front portion thereof with a box-shaped electric connection portion 11 provided therein with a spring, which is connected to a mating terminal and the like (not shown), and in the rear portion thereof with a wire connection portion 12 which is caulked and connected to the terminal portion of electric wire W (see FIG. 2) through the connection portion 13.

The wire connection portion 12 is provided with a conductor crimping portion 14 that is located in the front side thereof and a sheath caulking portion 15 that is located in the rear side thereof. The front side conductor crimping portion 14 is formed so as to have a substantially U-shaped cross section with a bottom plate 21 and a pair of conductor caulking pieces 22 which are extended upwardly from both side edges of the bottom plate 21 and which are bent inwardly to enclose a conductor Wa having been exposed by removing the insulation sheath Wb of the terminal portion of electric wire W to be connected thereto thereby caulking the conductor Wa so as to be in close contact with the upper surface of the bottom plate 21. Similarly, the sheath caulking portion 15 is formed so as to have a substantially U-shaped cross section with a bottom plate 23 and a pair of sheath caulking pieces 24 which are extended upwardly from the both side edges of the bottom plate 23 and which are bent inwardly to embrace a portion covered by the insulation sheath Wb of the terminal portion of the electric wire W to be connected thereto thereby caulking the insulation sheath Wb portion of the terminal portion of the electric wire W so as to be in close contact with the upper surface of the bottom plate 23.

Here, the bottom plate 21 of the conductor crimping portion 14 and the bottom plate 23 of the sheath caulking portion 15 are consecutively formed as a common bottom plate. In addition, the conductor caulking piece 22 of the conductor crimping portion 14 and the sheath caulking piece 24 of the sheath caulking portion 15 are provided therebetween with a pair of covering walls 17, as a consecutive wall of the conductor caulking piece 22 and the sheath caulking piece 24, which are plastically deformed so as to cover the portion between the conductor press-camping portion 14 and the sheath caulking portion 15 according to the caulking process of the conductor caulking pieces 22 and the sheath caulking pieces 24.

In addition, the entire inner surface of the wire connection portion 12 is provided with serrations (concave portions) in a direction intersecting with the longitudinal direction of the electric wire. In other words, as shown in FIGS. 1A and 1B, the inner surface of the conductor crimping portion 14 is provided with a plurality of serrations 31 (concave portions) to enhance the continuity of contact with the conductor Wa of W of electric wire W so as to be extended in the direction perpendicular to the longitudinal direction of the electric wire W. Similarly, the portion of the inner surface of the sheath caulking portion 15, which is in contact with the insulation sheath Wb of electric wire W, and the intermediate connection portion between the sheath caulking portion 15 and the conductor crimping portion 14 having the covering wall 17, which is in contact with the conductor Wa of electric wire W, are provided with a plurality of serrations 35 (concave portions) adhered to the conductor Wa and the sheath Wb by the caulking process, so as to be extended in the direction of intersecting with the longitudinal direction of the electric wire W. Also, convex portions may be provided instead of the serrations 35.

To get the connection structure according to the illustrative embodiment, the terminal portion of the electric wire W is inserted into the wire connection portion 12 of the crimping terminal 10A having the above-configuration, thereby the conductor Wa of the electric wire W is mounted on the upper surface of the bottom plate 21 of the conductor crimping portion 14, and at the same time, the electric wire W coated with the insulation sheath Wb is mounted on the upper surface of the sheath caulking portion 15. And, in this state, the pair of conductor caulking pieces 22 of the conductor crimping portion 14 is bent inwardly to embrace the conductor Wa to thereby caulk the conductor Wa so that the conductor Wa may be in close contact with the upper surface of the bottom plate 21, and at the same time, the pair of sheath caulking pieces 24 of the sheath caulking portion 15 is bent inwardly to enclose the conductor Wa thereby caulking the conductor Wa so that the conductor Wa may be in close contact with the upper surface of the bottom plate 21. In this way, as shown in FIG. 2, FIGS. 3A and 3B, the crimping terminal 10A may be press-connected to the electric wire W in the state where the serrations 35 formed on the inner surface of the sheath caulking portion 15 bite into the insulation sheath Wb of electric wire W.

Therefore, according to such a crimping terminal 10A, since the covering wall 17 is provided between the conductor caulking piece 22 of the conductor crimping portion 14 and the sheath caulking piece 24 of the sheath caulking portion 15, it is possible to reduce the exposure of the conductor Wa of the electric wire W in a caulked state. Also, since the serrations 35 adhered to the sheath Wa of electric W are formed on the inner surface of the sheath caulking portion 15 so as to be extended in the direction of crossing at right angles with the longitudinal direction of the electric wire W, when the sheath caulking piece 24 of the sheath caulking portion 15 is caulked to the terminal portion of the electric wire W, the serrations 35 on the inner surface of the coate cauliking portion 15 are penetrated into the sheath Wb of the electric wire W, thereby enhancing the adhesion between the inner surface of the sheath caulking portion 15 and the sheath Wb of the electric wire W. Moreover, since the serrations 35 are extended in the direction intersecting with the longitudinal direction of the electric wire W, as shown in FIGS. 3A and 3B, the penetration route of moisture S may be blocked by the complex contact configuration in which the serrations 35 are infiltrated into the sheath Wb even though moisture tries to penetrate toward the conductor Wa positioned deep inside from the rear end 15*e* of the sheath caulking portion 15, thereby enabling to aim at suppressing corrosion of the conductor.

Second Illustrative Embodiment

Figure 4A:
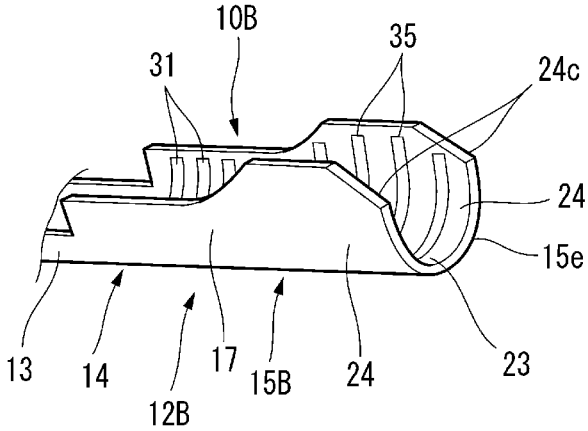
FIGS. 4A and 4B are configuration diagrams of a main part of a crimping terminal according to a second illustrative embodiment of the present invention.
Figure 4B:
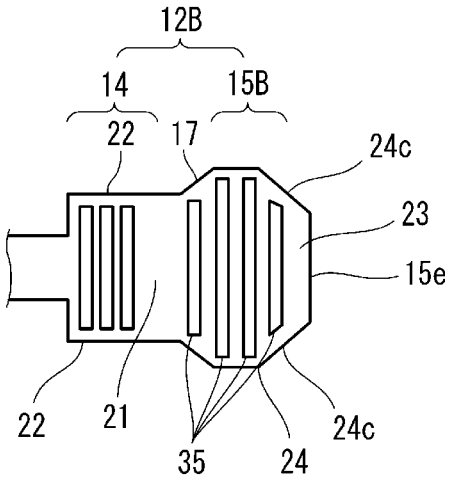
Figure 5:
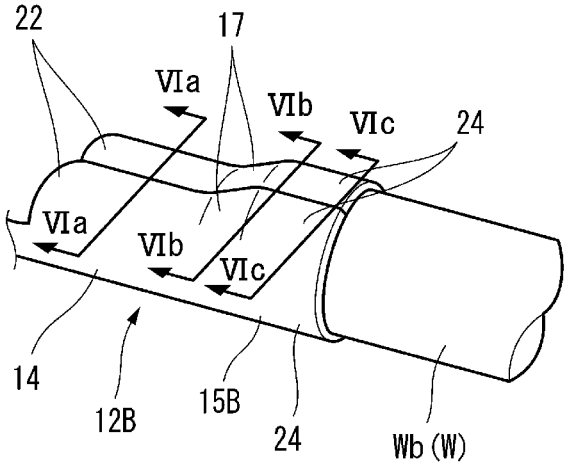
FIG. 5 is a perspective view showing a state in which the crimping terminal is caulked and connected to a terminal portion of electric wire.
Figures 6A, 6B, 6C:
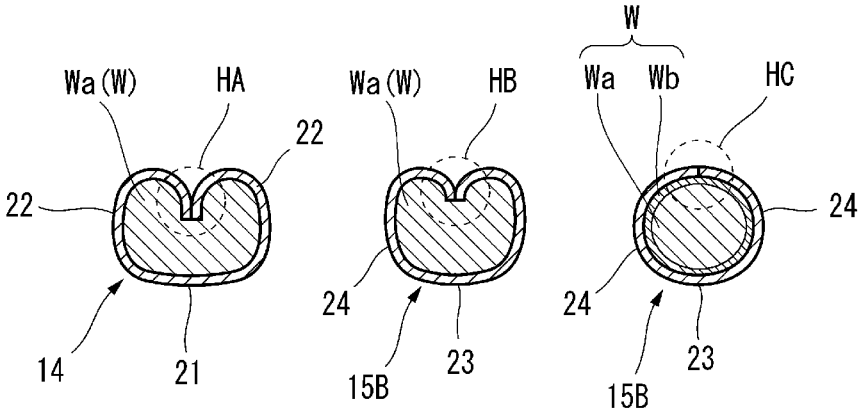
FIG. 6A is a cross sectional view taken along VIa-VIa of FIG. 5.
FIG. 6B is a cross sectional view taken along VIb-VIb of FIG. 5.
FIG. 6C is a cross sectional view taken along Vic-Vic of FIG. 5.

FIGS. 4A and 4B are configuration diagrams of a main part of a crimping terminal according to the second illustrative embodiment of the present invention, FIG. 4A is a perspective view, and FIG. 4B is a planar view. FIG. 5 is a perspective view showing a state in which the crimping terminal is caulked and connected to a terminal portion of electric wire. FIG. 6A is a cross sectional view taken along VIa-VIa shown in FIG. 5, FIG. 6B is a cross sectional view taken along VIb-VIb shown in FIG. 5, and FIG. 6C is a cross sectional view taken along Vic-Vic of FIG. 5.

As shown in FIGS. 4A and 4B, in the crimping terminal 10B according to the second illustrative embodiment, compared with the crimping terminal according to the first illustrative embodiment, a chamfered portion 24*c* having been cut obliquely is provided in the corner portion where an upper edge and a rear edge of the pair of sheath caulking pieces 24 having the substantially U-shaped section are intersected with each other.

In the case where the wire connection portion 12B of the crimping terminal 10B provided therein with the chamfered portion 24*c* is caulked to the terminal portion of the electric wire W to thereby obtain a connection structure of terminals and wires as shown in FIG. 5, as the cross section of each portion shown in FIGS. 6A to 6C is shown, there is a change in the method of biting into the electric wire W. First, as shown in FIG. 6A, the penetration (part shown in the HA) of the conductor caulking piece 22 of the conductor crimping portion 14 toward the electric wire W is deep, and as shown in FIG. 6B, and the sheath caulking piece 24 is still biting into the electric wire W by the front portion of the sheath caulking portion 15B. However, as shown in FIG. 6C, the penetration of the sheath caulking piece 24 toward the electric wire nearly disappears in the rear side of the sheath caulking portion 15B (see the part shown in the HC).

Therefore, since the penetration amount of the corner portion of the sheath caulking piece 24 toward the electric wire W is reduced, it is possible to suppress scratches on the insulation sheath Wb of the electric wire W.

Third Illustrative Embodiment

Figure 7A:
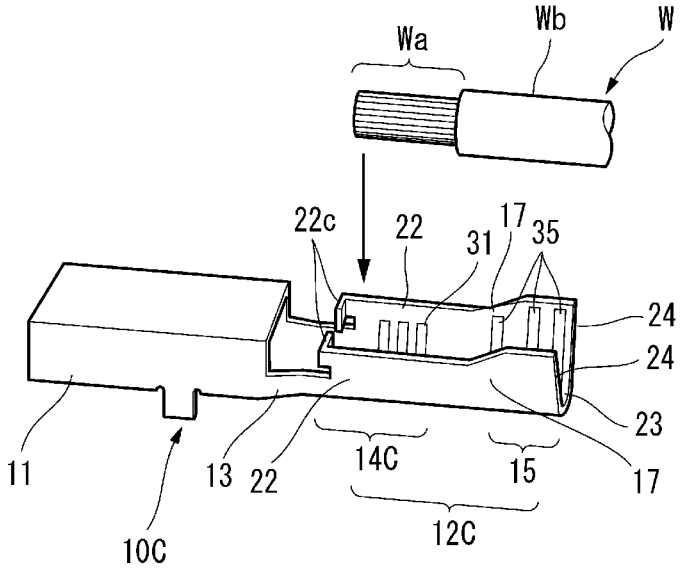
FIGS. 7A and 7B are configuration diagrams showing a crimping terminal according to a third illustrative embodiment of the present invention.
Figure 7B:
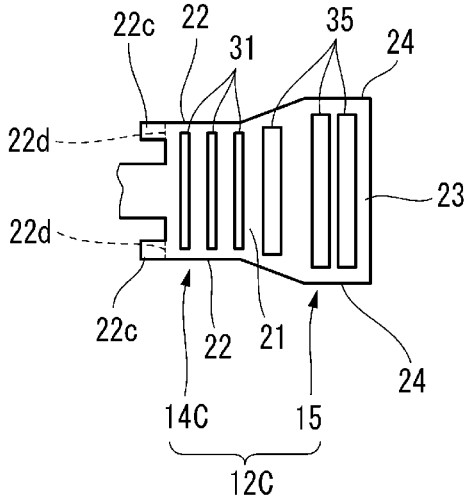
Figure 8:
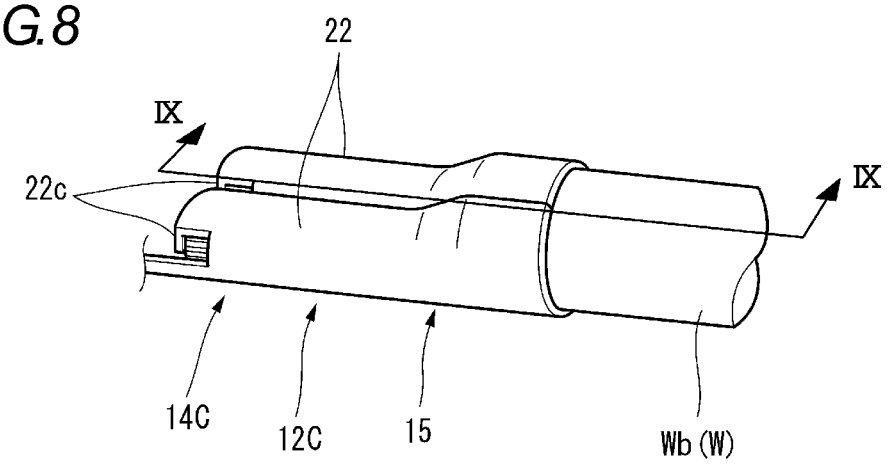
FIG. 8 is a perspective view showing a state in which the crimping terminal is caulked and connected to a terminal portion of electric wire.
Figure 9:
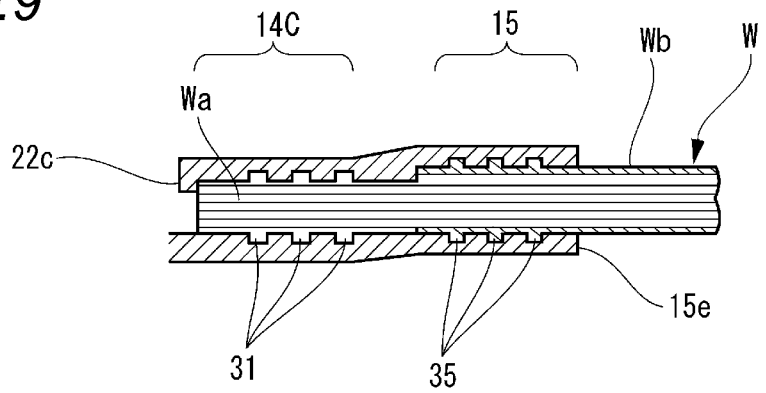
FIG. 9 is a cross sectional view taken along IX-IX of FIG. 8.

FIGS. 7A and 7B are configuration diagrams showing a crimping terminal according to the third illustrative embodiment of the present invention, FIG. 7A is a perspective view, and FIG. 7B is a planar view of a main part. FIG. 8 is a perspective view showing a state in which the crimping terminal is caulked and connected to a terminal portion of electric wire. FIG. 9 is a cross sectional view taken along IX-IX of FIG. 8.

As shown in FIG. 7A to FIG. 9, according to the crimping terminal 10*c* of the third illustrative embodiment, compared with the crimping terminal according to the first illustrative embodiment, it is characterized that the positioning piece 22*c* (position determining portion) regulating the position of the tip of the conductor Wa of the electric wire W inserted into the conductor crimping portion 14C is formed on the front portion of the pair of the conductor caulking piece 22 forming the conductor crimping portion 14C having the substantially U-shaped section of the wire connection portion 12C. The positioning portion 22*c* is formed by bending inwardly and at right angle the bending portion 22*d* of the base of the protrusion piece protruding at the edge of the front end of the conductor caulking piece 22.

Since the covering wall 17 is formed between the conductor caulking piece 22 of the conductor crimping portion 14C and the sheath caulking piece 24 of the sheath caulking portion 15, there is a case where it becomes difficult to determine the position of the conductor Wa of the electric wire W. As described in the foregoing, however, since the positioning piece 22*c* is provided in the crimping terminal 10C, it is possible to position easily and reliably the conductor Wa by striking the tip of the conductor Wa to the positioning portion 22*c*. Accordingly, it becomes easier to manage certainly the position of the electric wire W thereby enabling to aim at an improvement in the quality of crimping products.

Fourth Illustrative Embodiment

Figure 10:
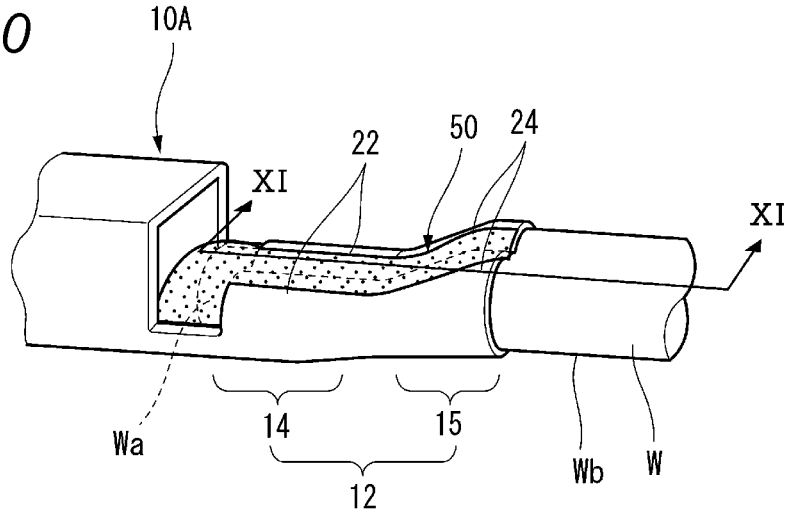
FIG. 10 is a perspective view of a connection structure according to a fourth illustrative embodiment showing a state where a anticorrosive is coated on a desired portion after the crimping terminal according to the first illustrative embodiment is caulked and connected to the terminal portion of electric wire.
Figure 11:
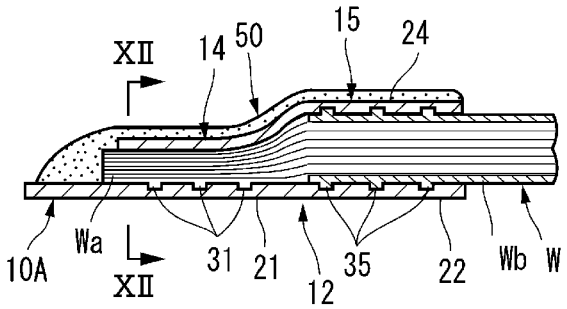
FIG. 11 is a cross sectional view taken along XI-XI of FIG. 10.
Figure 12:
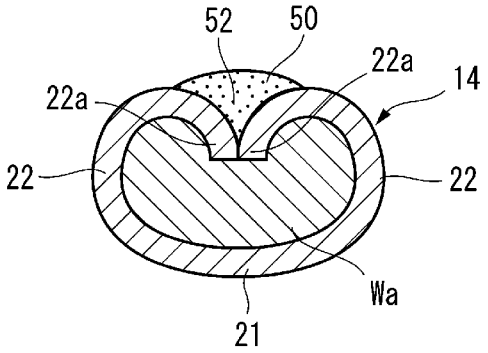
FIG. 12 is a cross sectional view taken along XII-XII of FIG. 11.
Figure 13:
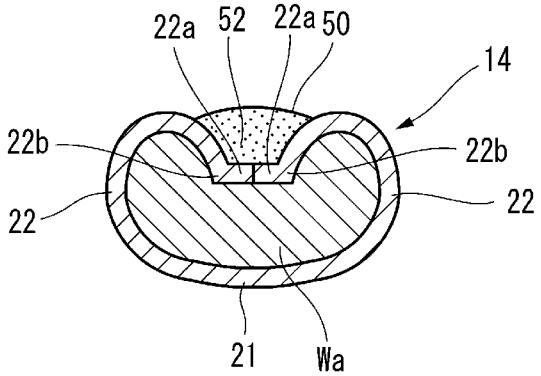
FIG. 13 is a cross-sectional view showing a modified example of the part shown in FIG. 12.
Figure 14:
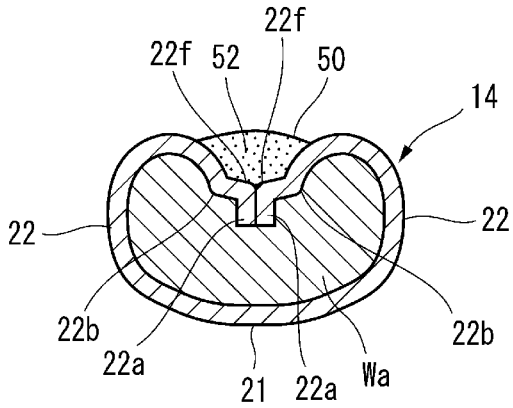
FIG. 14 is a cross-sectional view showing another modified example of the part shown in FIG. 12.

FIG. 10 is a perspective view of a connection structure according to the fourth illustrative embodiment showing a state where a anticorrosive is coated on a desired portion after the crimping terminal according to the first illustrative embodiment is caulked and connected to the terminal portion of electric wire. FIG. 11 is a cross sectional view taken along XI-XI of FIG. 10. FIG. 12 is a cross sectional view taken along XII-XII of FIG. 11. FIG. 13 is a cross-sectional view showing a modified example of the part shown in FIG. 12. FIG. 14 is a cross-sectional view showing another modified example of the part shown in FIG. 12.

As shown in FIG. 10 to FIG. 12, according to the connection structure, it is characterized that the portion which is in the range from the conductor Wa exposed in the front side of the conductor crimping portion 14 to the overlapped portion of the pair of the sheath caulking pieces 24 via the overlapped portion of the pair of the conductor caulking pieces 22 is covered with the anticorrosive 50, in the state where the terminal portion of the electric wire W is set to the wire connection portion 12 of the crimping terminal 10A according to the first illustrative embodiment and the conductor caulking piece 22 of the conductor crimping portion 14 and the sheath caulking piece 24 of the sheath caulking portion 15 are caulked to the terminal portion of electric wire.

As shown in FIG. 12, when the caulking process is performed, the tips 22*a* of the pair of the conductor caulking pieces 22 of the pair of conductor crimping portion 14 penetrate into the conductor Wa while being rubbed with each other, and then a small dent 52 is formed on the overlapped portion of the pair of conductor caulking pieces 22. In addition, although not shown, as it is also the same for the sheath caulking portion 15, a small dent 52 is formed on the overlapped portion of the pair of the sheath caulking pieces 24.

The anticorrosive 50 is filled in or coated on the dent 52 formed in such a way. For example, the anticorrosion grease, UV-curable resin and the like may be employed as the anticorrosive 50, which may be coated on the object with a brush, or by discharging resin through a nozzle and the like.

In such a way, according to the connection structure in which the caulking portion is covered with the anticorrosive 50, since the infiltration or adhesion of moisture toward the conductor Wa may be suppressed by the anticorrosive 50, a higher corrosion-inhibition effect may be obtained thereby enabling to aim at a greater improvement in the reliability thereof.

In addition, the combined structure of the tips 22*a* of the pair of the conductor caulking pieces 22, as shown in FIG. 13, may includes one structure in which the bending portion 22*b* is formed near the tip 22*a* of the conductor caulking piece 22 and the tips 22*a* are in contact with each other accordingly, or, as shown in FIG. 14, another structure in which the bending portions 22*b*, 22*f* of two stages is formed and the outer surfaces of the tips 22*a* are rubbed with each other accordingly. In the case where these structures are adopted, since the size of the dent 52 formed on the combined portion of the pair of the conductor caulking piece 22 may be enlarged, a more sufficient amount of anticorrosive 50 may be coated, thereby aiming at an improvement in the waterproof performance.

Fifth Illustrative Embodiment

Figure 15A:
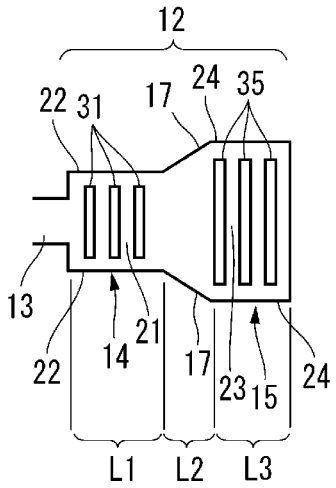
FIGS. 15A to 15C are explanatory diagrams illustrating the improvement in the crimping terminal according to the first illustrative embodiment.
Figure 15B:
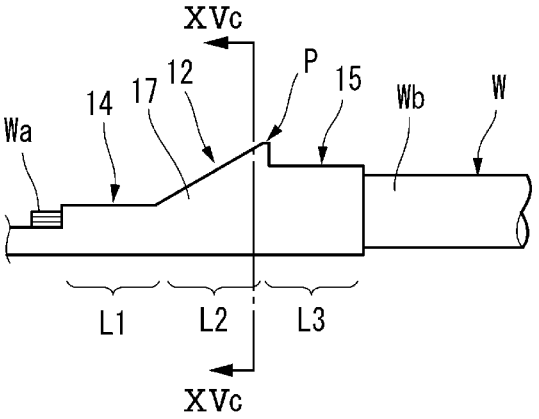
Figure 15C:
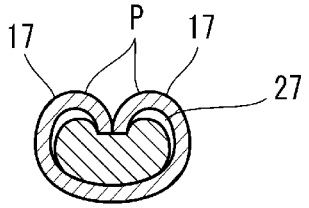
Figure 16:
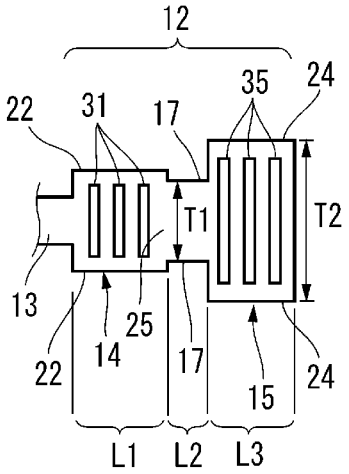
FIG. 16 is a planar view showing a main part of a crimping terminal according to a fifth illustrative embodiment of the present invention.
Figure 17A:
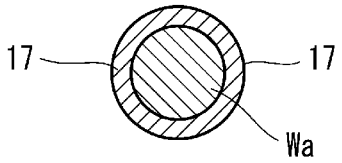
FIGS. 17A and 17B are cross-sectional views showing the caulked state of the part L2 (the portion provided with the covering wall) shown in FIG. 16.
Figure 17B:
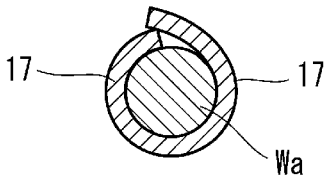
Figure 18A:
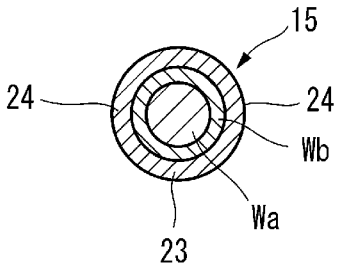
FIGS. 18A and 18B are cross-sectional views showing the caulked state of the part (a portion of the sheath caulking portion) indicated by L3 in FIG. 16.
Figure 18B:
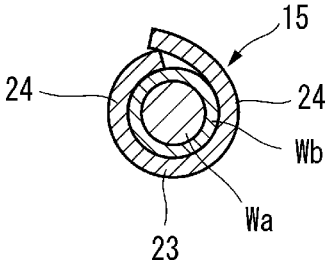

FIGS. 15A to 15C, as a prerequisite of the fifth illustrative embodiment, are explanatory diagrams illustrating the improvement in the crimping terminal according to the first illustrative embodiment, FIG. 15A is a planar view of a main part of the crimping terminal before the improvement, FIG. 15B is a side view showing the caulked state of the crimping terminal, and FIG. 15C is a cross-sectional view taken along XVc-XVc of FIG. 15B. FIG. 16 is a planar view showing a main part of the crimping terminal according to a fifth illustrative embodiment of the present invention. FIGS. 17A and 17B are cross-sectional views showing the caulked state in the part L2 (the portion provided with the covering wall) shown in FIG. 16, FIG. 17A is a view showing an example in which the upper edges of the covering wall are combined with each other, and FIG. 17B is a diagram showing an example in which one of the upper edges of the covering wall slightly overhangs the other thereof. FIGS. 18A and 18B are cross-sectional views showing the caulked state of the part (portion of the sheath caulking portion) indicated by L3 in FIG. 16, FIG. 18A is a view showing an example in which upper edges of the sheath caulking pieces are combined with each other, and FIG. 18B is a diagram showing an example in which one of the upper edges of the sheath caulking pieces slightly overhangs the other thereof.

First, as shown in FIG. 15A, the conductor connection portion 12 of the crimping terminal is provided with the conductor crimping portion 14 positioned in the front side thereof and the sheath caulking portion 15 positioned in the rear side thereof. The conductor crimping portion 14 positioned in the front side thereof is formed so as to have a U-shaped cross-section with the bottom plate 21 and the pair of conductor caulking pieces 22, and the sheath caulking portion 15 positioned in the rear side thereof is formed so as to have a U shaped cross-section with the bottom plate 23 and the pair of sheath caulking pieces 24. In addition, the portion from the bottom plate 21 of the conductor crimping portion 14 to the bottom plate 23 of the sheath caulking portion 15 is consecutively formed as a common bottom plate, and a pair of covering walls 17 are formed as continuous walls between the conductor caulking piece 22 of the conductor crimping portion 14 and the sheath caulking piece 24 of the sheath caulking portion 15.

In FIG. 15A, the range of the conductor crimping portion 14 in the longitudinal direction of the terminal (longitudinal direction of wire) is designated by L1, the range in which the covering wall 17 exists is designated by L2 and the range of the sheath caulking portion 15 is designated by L3. In this case, since the upper edge of the conductor caulking piece 22 of the conductor crimping portion 14 is lower in its height than the upper edge of the sheath caulking piece 24 of the sheath caulking portion 15, the upper edge of the covering wall 17 that is continuously formed from the conductor crimping portion 14 to the sheath caulking portion 15 is formed in a straight-line shape extended obliquely with respect to the longitudinal direction of the bottom plates 21, 23.

As shown in FIGS. 15B and 15C, by the geometric characteristics of such a cover wall 17, the bulge portion P bulged upward may be created when the caulking is performed, and in its part, the gap 27 may be formed between the covering wall 17 and the conductor Wa. If there is a useless gap as such, moisture is more likely to penetrate into it.

Accordingly, as shown in FIG. 16, according to the crimping terminal of the fifth illustrative embodiment, the upper edges (Part L2) of the pair of the covering walls 17 are formed in a straight line shape parallel to the bottom plate 21, 23, and the size T1 from the upper edge of one of the pair of the covering walls 17 to the upper edge of the other of the pair of the covering walls 17 is set to correspond to the diameter (or circumference length) of the conductor Wa of the electric wire W enclosed by its size.

That is, when the conductor W is enclosed, as at least the condition that a gap is not formed between the tips (upper edges) of the covering walls 17, the length T1 is set so that the tips (upper edges) of the covering wall 17 are in face contact with each other as shown in FIG. 17A, or, one of the tips (upper edges) of the covering wall 17 is slightly overlapped with the other thereof as shown in FIG. 17B. Otherwise, the length may be set in the degree that the tips of the covering wall 17 slightly penetrate toward the conductor Wa, as in the conductor crimping portion 14 or the sheath caulking portion 15.

Similarly, even the size T2 from the upper edge of one of the sheath caulking pieces 24 of the sheath caulking portion 15 to the upper edge of the other of the sheath caulking pieces 24 is set to correspond to the diameter (or circumference length) of the portion where the insulation sheath Wb of the electric wire W to be enclosed is adhered thereto. That is, when the conductor W is enclosed, as at least the condition that a gap is not formed between the tips (upper edges) of the sheath caulking pieces 24, the length T2 is set so that the tips (upper edges) of the sheath caulking pieces 24 are in face contact with each other as shown in FIG. 18A, or, one of the tips (upper edges) of the sheath caulking pieces is slightly overlapped with the other thereof as shown in FIG. 18B. In addition, the length may be set in the degree that the tips of the sheath caulking pieces 15 slightly penetrate toward the insulation sheath Wb.

In the case of using such a crimping terminal, it is possible to avoid any useless gap formed between the terminal and the electric wire thereby enhancing the effect of suppressing the infiltration of moisture.

Figure 19:
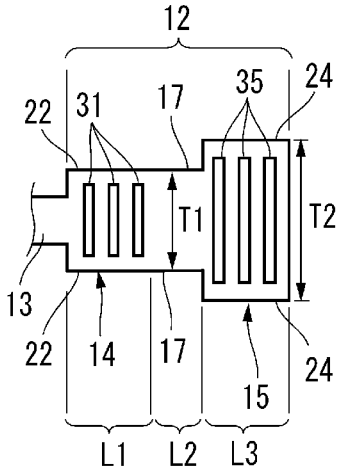
FIG. 19 is a planar view showing a modified example of a main part of the crimping terminal according to the fifth illustrative embodiment of the present invention.
Figure 20:
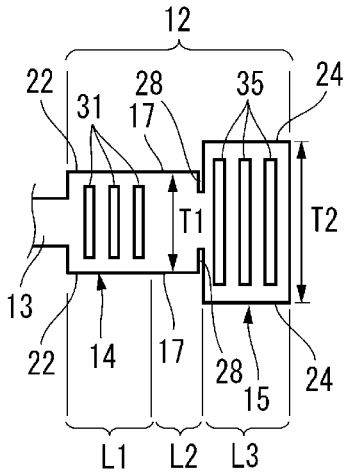
FIG. 20 is a planar view showing another modified example of a main part of the crimping terminal according to the fifth illustrative embodiment of the present invention.
Figure 21:
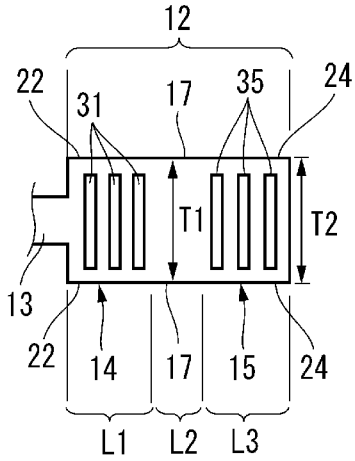
FIG. 21 is a planar view showing still another modified example of a main part of the crimping terminal according to the fifth illustrative embodiment of the present invention.
Figure 22:
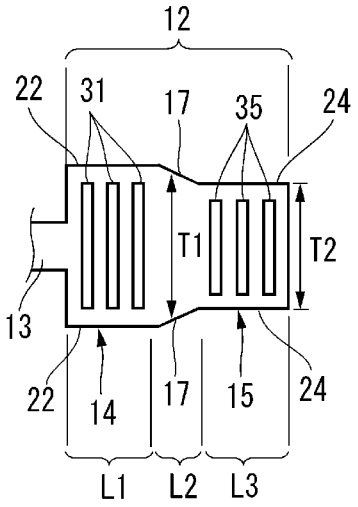
FIG. 22 is a planar view showing yet another modified example of a main part of the crimping terminal according to the fifth illustrative embodiment of the present invention.
Figure 23A:
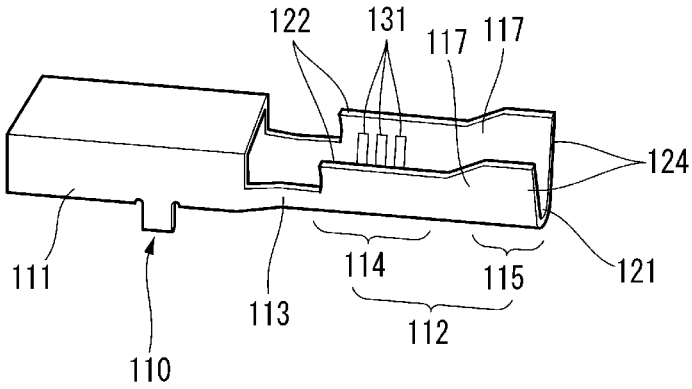
FIGS. 23A and 23B are configuration diagrams of a conventional crimping terminal disclosed in Patent Document 1.
Figure 23B:
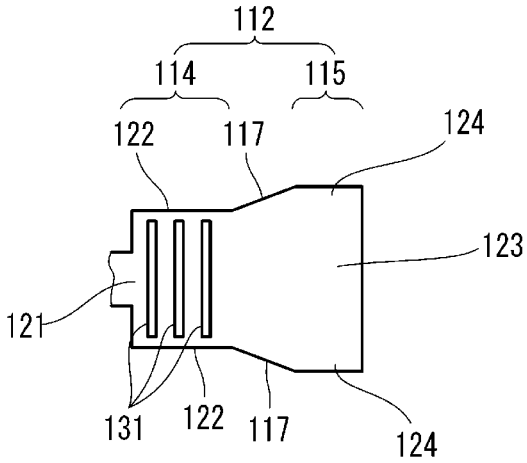
Figure 24:
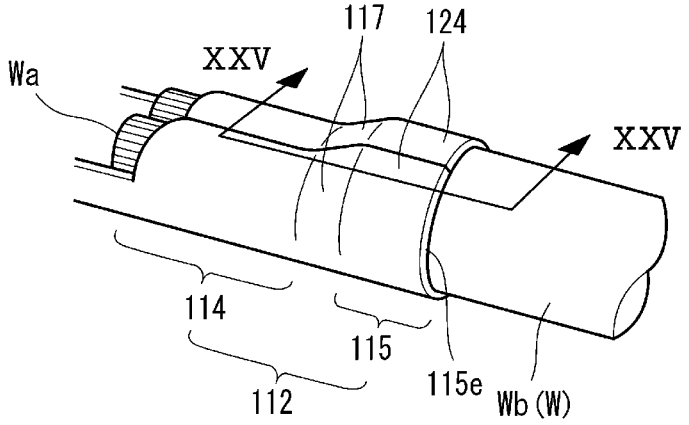
FIG. 24 is a perspective view showing a state in which the crimping terminal is caulked and connected to the terminal portion of electric wire.
Figure 25:
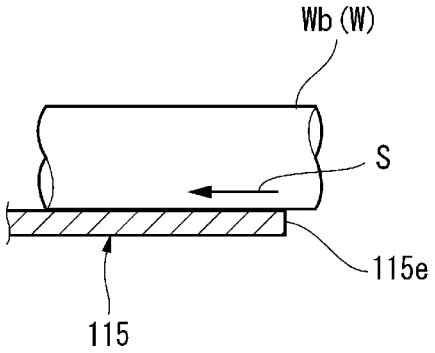
FIG. 25 is a cross sectional view taken along XXV-XXV in FIG. 24.

Also, as long as the condition of the size T1 described above is maintained, it is possible to change the shape of the wire connection portion 12, for example, the following modifications may also be adopted. As shown in FIG. 19, the size between the upper edges of the conductor caulking pieces 22 may be set so as to have the same length as the size T1 between the upper edges of the covering walls 17. In addition, as shown in FIG. 20, a notch 28 may be formed between the covering wall 17 and the sheath caulking piece 24 thereby making it easier to perform the caulking. Also, as shown in FIG. 21, the portion in the range from the upper edge of the conductor caulking piece 22 to the upper edge of the sheath caulking piece 24 through the upper edge of the covering wall 17 may be formed in a continuous straight line shape, thereby the size between the upper edges of the conductor caulking pieces 22, the size T1 between the upper edges of the covering walls 17 and the size T2 between upper edges of the sheath caulking pieces 24 may be set so as to have all the same size. Further, as shown in FIG. 22, the upper edge of the sheath caulking piece 24 may be lower in its height than the upper edge of the conductor caulking portion 22, thereby the upper edge of the covering wall 17 may be formed in a straight line shape extended obliquely.

The present invention is not limited to the illustrative embodiments described above, but appropriate modifications, improvements and the like may be possible. In the illustrative embodiments described above, material, shape, size, number, arrangement location and the like in each element may be determined arbitrarily as long as they realize the present invention, thus are not limitative of the present invention.

For example, although the illustrative embodiments described above disclose the case where the serrations 35 (concave portions) are formed on the inner surface of the sheath caulking portion 15, convex portions may be formed instead of the serrations. Also, the serrations or convex portions may not be extended in the direction of crossing at right angles with the longitudinal direction of the electric wire, instead, may be extended just in the direction of intersecting with the longitudinal direction of electric wire.

Although the invention is described in detail and with reference to the specific type of illustrative embodiment, it is obvious for a skilled person to add a change or a modification to the invention without departing from the spirit and the scope thereof.

The application is based on Japanese Patent Application No. 2010-081810, filed on Mar. 31, 2010, and the contents of which are hereby incorporated herein by reference.

DESCRIPTION OF REFERENCE NUMERALS

W: electric wire
Wa: conductor
Wb: insulation sheath
10A, 10B, 10C: crimping terminal
12: wire connection portion
14: conductor crimping portion
15: sheath caulking portion
17: covering wall
21: bottom plate
22: conductor caulking piece
22*c*: positioning portion (position determining portion)
23: bottom plate
24: sheath caulking piece
24*c*: chamfered portion
31, 35: serration (concave portions)
50: anticorrosive

The invention claimed is:

1. A crimping terminal having an electric connection portion for connecting to a mating terminal in a front portion thereof and a wire connection portion that is caulked and connected to a terminal portion of electric wire in a rear portion thereof, wherein the wire connection portion is provided with a conductor crimping portion positioned in a front side thereof and a sheath caulking portion positioned in a rear side thereof, wherein the conductor crimping portion is formed so as to have a substantially U-shaped cross section with a bottom plate and a pair of conductor caulking pieces which are extended upwardly from both side edges of the bottom plate and bent inwardly to enclose a conductor having been exposed by removing an insulation sheath of a terminal of an electric wire to be connected thereto thereby caulking the conductor so that the conductor is in close contact with an upper surface of the bottom plate, wherein the sheath caulking portion is formed so as to have a substantially U-shaped cross section with a bottom plate and a pair of sheath caulking pieces which are extended upwardly from the both side edges of the bottom plate and bent inwardly to enclose an insulation sheath portion of a terminal of an electric wire to be connected thereto thereby caulking the insulation sheath portion so that the insulation sheath portion is in close contact with an upper surface of the bottom plate, wherein the bottom plate of the conductor crimping portion and the bottom plate of the sheath caulking portion are formed as a common bottom plate, and the conductor caulking pieces and the sheath caulking pieces are formed therebetween with a pair of continuous covering walls, the pair of continuous covering walls configured to enclose the electric wire between the conductor caulking pieces and the sheath caulking pieces, and wherein the wire connection portion is provided on an entire inner surface of the wire connection portion with concave portions or convex portions in a direction of intersecting with a longitudinal direction of the electric wire.

2. The crimping terminal according to claim 1, wherein a chamfered portion is provided in a corner portion where an upper edge and a rear edge of the pair of sheath caulking pieces are intersected with each other.

3. The crimping terminal according to claim 1, wherein the conductor crimping portion or a front side of the conductor crimping portion is provided with a positioning portion to regulate a position of a tip of the conductor of the electric wire inserted into the conductor crimping portion.

4. The crimping terminal according to claim 1, wherein upper edges of the pair of covering walls are formed in a straight line shape parallel to the bottom plate, and a distance from the upper edge of one of the covering walls to the upper edge of the other of the covering walls is set to be substantially equal to a diameter of the conductor of the electric wire.

5. A connection structure of the crimping terminal to the electric wire, wherein: the wire connection portion of the crimping terminal according to claim 1 is inserted with the terminal portion of the electric wire so that the conductor of the electric wire is mounted on an upper surface of the bottom plate of the conductor crimping portion and the insulation sheath portion of the electric wire is mounted on the upper surface of the bottom plate of the sheath caulking portion;

in that state, the pair of conductor caulking pieces of the conductor crimping portion is bent inward to enclose the conductor thereby caulking the conductor so that the conductor is in close contact with the upper surface of the bottom plate, and the pair of sheath caulking pieces of the sheath caulking portion is bent inward to enclose the insulation sheath portion thereby caulking the insulation sheath portion so that the insulation sheath portion is in close contact with the upper surface of the bottom plate; and whereby the concave portions or the convex portions formed on the entire inner surface of the wire connection portion penetrate the conductor of the electric wire and the insulation sheath.

6. The connection structure of the crimping terminal to the electric wire, according to claim 5, wherein an anticorrosive is coated on a portion which ranges from the conductor exposed in the inside or the front side of the conductor crimping portion to an overlapped portion of the pair of the sheath caulking pieces through an overlapped portion of the pair of the conductor caulking pieces, in a state where the conductor caulking pieces of the conductor crimping portion and the sheath caulking pieces of the sheath caulking portion are caulked to the terminal portion of the electric wire.

* * * * *